US006032575A

United States Patent [19]

Johnson

[11] Patent Number: 6,032,575

[45] Date of Patent: Mar. 7, 2000

[54] AUTOMATIC BALER WITH TYING SYSTEM HAVING SIMULTANEOUSLY ENGAGED TWISTER PINIONS

[75] Inventor: Gerald L. Johnson, Carthage, Mo.

[73] Assignee: L&P Property Management Company, Southgate, Calif.

[21] Appl. No.: 09/116,840

[22] Filed: Jul. 16, 1998

[51] Int. Cl.[7] ..... B65B 13/28

[52] U.S. Cl. ..... 100/11; 100/20; 100/21; 100/31

[58] Field of Search ..... 100/3, 11, 17–24, 100/31

[56] References Cited

U.S. PATENT DOCUMENTS

| | | | |
|---|---|---|---|
| 218,741 | 8/1879 | Higgins . | |
| 399,856 | 3/1889 | Eisenhart . | |
| 664,326 | 12/1900 | Kintzing . | |
| 743,520 | 11/1903 | Kennedy . | |
| 761,305 | 5/1904 | Johnson | 100/11 |
| 801,983 | 10/1905 | Hubbard | 100/11 |
| 875,654 | 12/1907 | Christensen . | |
| 893,216 | 7/1908 | Wood | 100/11 |
| 985,023 | 2/1911 | Fry . | |
| 989,260 | 4/1911 | Hinckley . | |
| 1,031,444 | 7/1912 | Heim | 100/20 |
| 1,180,934 | 4/1916 | Mottier . | |
| 1,507,376 | 9/1924 | Hintz . | |
| 1,581,794 | 4/1926 | DeHaven, Jr. . | |
| 1,699,482 | 1/1929 | Stevens . | |
| 1,706,116 | 3/1929 | Harrah . | |
| 1,871,885 | 8/1932 | Howard | 100/11 |
| 1,889,372 | 11/1932 | Nolan . | |
| 2,098,945 | 11/1937 | Davis . | |
| 2,173,403 | 9/1939 | Trimble . | |
| 2,757,599 | 8/1956 | Nolt et al. . | |
| 2,777,384 | 1/1957 | Nolt et al. . | |
| 2,792,776 | 5/1957 | Tarbox . | |
| 2,796,662 | 6/1957 | Saum . | |
| 2,859,687 | 11/1958 | Hill . | |
| 2,868,239 | 1/1959 | Ellis . | |

(List continued on next page.)

FOREIGN PATENT DOCUMENTS

| | | |
|---|---|---|
| 152933 | 8/1953 | Australia . |

OTHER PUBLICATIONS

United States Steel, *Round Steel Strapping Machines—Manually Operated*, Sales Material, undated, 2 pages.

*Primary Examiner*—Stephen F. Gerrity
*Attorney, Agent, or Firm*—Wood, Herron & Evans, LLP

[57] ABSTRACT

An automatic baler for creating a bale of compressible material comprises a mechanism for compressing an amount of the material into a bale and moving the bale along a path past a continuous strand of wire which extends across the path to engage a front end of the bale and wrap around the bale as it moves along said path. Opposing arm elements positioned on opposite sides of the path are movable toward each other to engage the path and are operable for engaging sections of the continuous wire strand. The opposing arm elements form at least two overlapped sections of wire proximate the rear end of the bale, and a twisting mechanism with twister pinions engages the overlapped wire sections to simultaneously tie the overlapped wire sections to both secure the wire wrapped around the bale and to reform a continuous strand of wire to engage the next bale.

20 Claims, 5 Drawing Sheets

U.S. PATENT DOCUMENTS

| | | |
|---|---|---|
| 2,922,359 | 1/1960 | Brouse et al. . |
| 2,982,199 | 5/1961 | Jones . |
| 3,149,559 | 9/1964 | Lynch . |
| 3,541,828 | 11/1970 | Norman . |
| 3,794,086 | 2/1974 | Hall et al. . |
| 3,918,358 | 11/1975 | Burford . |
| 4,120,238 | 10/1978 | Schafer et al. . |
| 4,155,296 | 5/1979 | Schafer . |
| 4,157,274 | 6/1979 | Johnson, III et al. . |
| 4,164,176 | 8/1979 | Brouse et al. . |
| 4,167,902 | 9/1979 | Bister et al. . |
| 4,177,724 | 12/1979 | Johnson, III et al. . |
| 4,178,845 | 12/1979 | DeGryse . |
| 4,228,733 | 10/1980 | Davis et al. . |
| 4,256,032 | 3/1981 | Davis . |
| 4,459,904 | 7/1984 | Probst et al. . |
| 4,572,554 | 2/1986 | Janssen et al. . |
| 4,577,554 | 3/1986 | Brouse . |
| 4,587,791 | 5/1986 | Brouse et al. . |
| 4,817,519 | 4/1989 | Brouse et al. . |
| 5,279,336 | 1/1994 | Kusakari et al. . |

AUTOMATIC BALER WITH TYING SYSTEM HAVING SIMULTANEOUSLY ENGAGED TWISTER PINIONS

FIELD OF THE INVENTION

The present invention relates generally to tying or binding bales of compressed material within a baler. More specifically, the invention relates to an apparatus and method for automatically tying bales in succession with continuous strands of baling wire supplied in the bale path.

BACKGROUND OF THE INVENTION

Various types of bulk materials are shipped, stored, and otherwise processed and distributed in the form of compressed bales. For example, such items as recyclable paper products and cotton are processed into compressed bales so that they may be more easily handled. Baling also allows a greater amount of such products to be stored and shipped in a smaller space than would be possible with loose bulk material. As is appreciated, bales are also substantially easier to handle than the loose bulk material.

It is generally known to wrap such bales of compressible material with wire or other elongated binding devices to keep the bales in a compressed form, such as for shipping, handling, and storage. Wire is often most preferable as a binding material because of its low cost and the ease with which it is handled. To bind a bale, the wire is wrapped in strands around the bale. The ends of the wire strands are then twisted and tied around the bales after the strands are wrapped and positioned on the bale.

One notable method for tying a bale is referred to as the automatic tie method or auto-tie method in which a bundle of loose, compressible material is pressed into a bale by a ram and moved by the ram through the baler. A plurality of continuous wire strands extend across the bale path at different positions along the bale and are fed by supply rollers positioned on either side of the bale path. As the bale moves through the baler, the bale is forced against the wires and the wires are wrapped around the bale. At a predetermined position along the bale path, a twisting mechanism engages sections of wire wrapped around the bales and twists the respective sections together. One side of the wire twist forms a completed tie or wrap around the bale, while the other side of the twist again reforms a continuous strand of baling wire between the supply rolls along the bale path. Examples of various auto-tie methods are illustrated in U.S. Pat. Nos. 4,120,238; 4,155,296; 4,167,902; 4,459,904 and 5,704,283.

While such methods have generally proven somewhat suitable for baling and tying compressed bales, currently available methods have several drawbacks which reduce the efficiency of the baling process and further reduce the strength of the wire ties or wraps. For example, existing methods and apparatuses require complicated mechanisms which must manipulate and twist the various wire ends to tie the bale and retie the loose ends from the supply rolls into continuous wire strands to engage a subsequent bale. Such mechanisms require synchronization and precise movements to twist and tie one set of loose ends, such as around the bale, and then to tie another set of loose wire ends, such as to complete and reform the continuous strands of baling wire. The two-step tying process is inefficient and slows down bale production.

Another drawback to existing methods and apparatuses is that the complicated and expensive systems used to make the wire twists in automatic balers are expensive to manufacture and maintain.

Therefore, it is an objective of the present invention to bind and tie a bale of compressible material quickly and efficiently within an automatic baler system.

It is another objective to reduce the manufacturing and maintenance costs associated with prior art twisting and tying mechanisms used in automatic balers.

It is another objective to be able to tie successive bales while maintaining a continuous strand of baling wire to engage a subsequent bale to the one currently tied.

SUMMARY OF THE INVENTION

The above-stated objectives and other objectives are addressed by an automatic baler which creates a bale of compressible material quickly and efficiently, wrapping and tying the bales with a strong, durable twist and reforming continuous strands of baling wire to receive another subsequent bale. The automatic baler of the invention is relatively inexpensive to manufacture and maintain. The automatic baler comprises a mechanism for compressing an amount of compressible material into a bale and moving the bale along the path. Preferably such a compressing mechanism includes a baling ram with a ram head which pushes the compressible material to form the compressed bale. A supply of baling wire forms a continuous strand which extends transverse to the path on which the bale is moving to engage the front end of the bale and wrap around the front end and sides of the bale as it moves along the path.

At a certain position along the path, opposing arm elements positioned on opposite sides of the path move toward each other to engage the path. Preferably, the arm elements move in a direction transverse to the path. The opposing arm elements are operable for engaging sections of the continuous wire strand wrapped around the bale to move the strand sections across the rear end of the bale. More specifically, the arm elements are operable for forming opposing loops of wire, each loop having an upstream section and a downstream section proximate the rear end of the bale. The loops overlap to form overlapped wire sections. The wire loops oppose each other such that the downstream sections of the loops overlap to form a bale overlapped section of wire, and the upstream sections of the loops overlap to form a supply overlapped section of the wire. A cutting mechanism, including a blade, is positioned on each of the arms, such that when the arms come together and the loops form the bale overlapped section and the supply overlapped section, the wire loops are cut in half between the various overlapped sections. Thereby, free loop ends of the wire wrapped around the bale are positioned directly behind the bale, and free loop ends of the supply wire are also behind the bale.

A twisting mechanism, including at least two twister pinions, engages the overlapped wire sections simultaneously. The twister pinions, which are preferably positioned side-by-side, twist and tie the bale overlapped section and twist and tie the supply overlapped section simultaneously. When the bale overlapped section is twisted by the twister pinions and tied, the bale is completed. When the supply overlapped section is tied, the continuous strand of baling wire is reformed to again extend across the path to engage the next successive bale moving along the path. In that way, successive bales are automatically and continuously tied, and the bales are completed at generally the same time the continuous wire strand is reformed to receive the next bale.

In a preferred embodiment of the invention, multiple sets of opposing arm elements and multiple pinions are utilized to wrap each bale with several strands of wire simultaneously. The pinions are stacked vertically, along with the opposing arm elements and the twisting mechanism, including pinions, is positioned within the head of a baler ram which compresses the compressible material into a bale. The head of the ram includes slots formed in sidewalls thereof for receiving the opposing arm elements. The bale ram and bale move up to a certain position along the path, and the opposing arms extend into sidewall slots of the bale head to overlap proximate the twisting mechanism with its multiple twister pinions. The multiple twister pinions then engage the overlapped wire sections created by the various sets of opposing arm elements to twist the overlapped wire sections associated therewith to tie the bale and to reform the continuous strands of wire which extend across the baling path. After the twister pinions engage and twist the wires, the arms are withdrawn from the ram head. Appropriately formed notches in the opposing arm elements allow the twister pinions to engage the overlapped wire sections. Once the overlapped sections of wire are twisted and tied, the twisted wires slide out of the baler ram head through slots in the front of the ram head as the ram is withdrawn upstream to compress the next successive bale.

BRIEF DESCRIPTION OF THE FIGURES

The accompanying drawings, which are incorporated in and constitute a part of this specification, illustrate embodiments of the invention and, together with a general description of the invention given below, serve to explain the principles of the invention.

DETAILED DESCRIPTION OF THE INVENTION

Figure 1A:
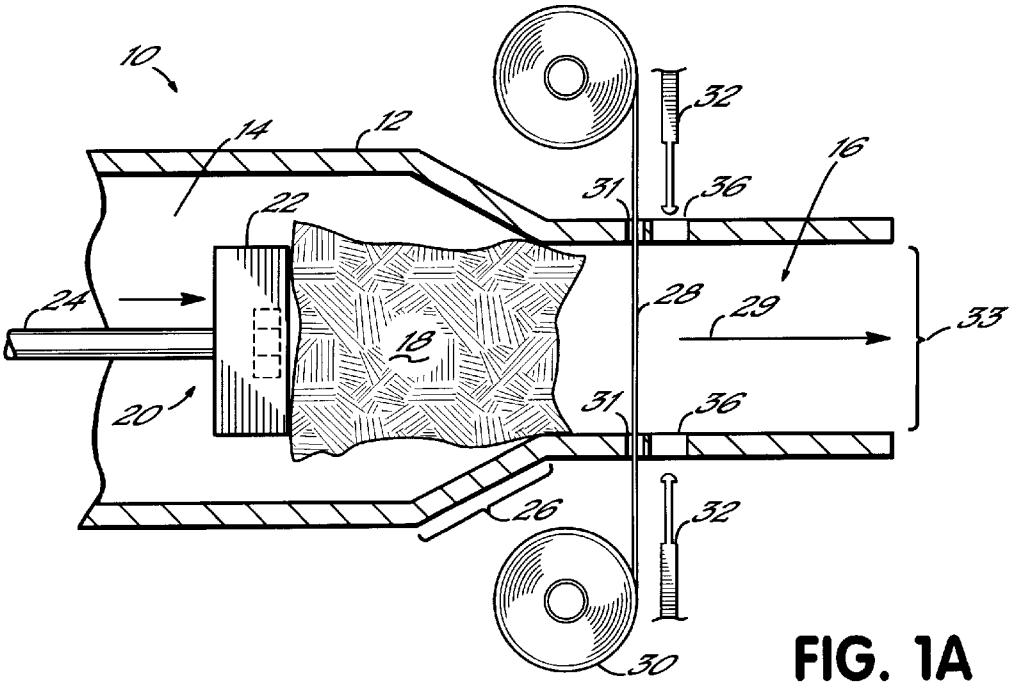
FIGS. 1A–1F are top cross-sectional views of an automatic baler consistent with the present invention, showing a bale progressing through the baler.

FIGS. 1A–1F show top cross-sectional views consistent with the invention of an automatic baler moving a bale of compressible material along a baling path. Specifically, the automatic baler 10 of the invention includes a frame 12 forming a hopper area 14 and a baling area 16. Generally, an amount of the compressible material 18 will be delivered into the hopper area 14 in front of a compressing mechanism which may include a ram 20. Ram 20 includes a moveable ram head 22 and shaft 24 for pushing the ram head along a baling path 29. The shaft 24 is coupled to an appropriate mechanism, such as a pneumatic or hydraulic mechanism for moving the ram head 22. Compressible material 18 is pushed from the hopper area 14 into the narrower baling area 16 generally past a transition section 26 which funnels the compressible material into a smaller shaped bale 18 under the force of the baling ram 20. A supply of baling wire 30 forms a continuous strand of wire 28 which extends across and generally transverse to the path 29 along which the bale is moving. A supply 30 of baling wire, such as spools, as shown, may be positioned on either side of the path 29 to form and feed the continuous strand of wire 28 across the path. The wire from the spools 30 extends into the path 29 through appropriately formed openings 31 in the sides of the frame 12 of baler 10. Frame 12 might also be configured to encase the spools 30. Opposing arm elements 32 are positioned on either side of path 29 to engage the wire strand 28 when it is wrapped around the bale and facilitate tying the strand at various points as described further hereinbelow.

In a preferred embodiment of the invention, multiple sets of opposing arm elements 32 are positioned generally in a vertical orientation for wrapping and tying several strands of wire around a bale of compressible material 18 at vertically spaced positions on the bale. To that end, multiple wire strands 28 are positioned across path 29 at various vertical positions with respect to the bale (see FIG. 3).

Figure 1B:
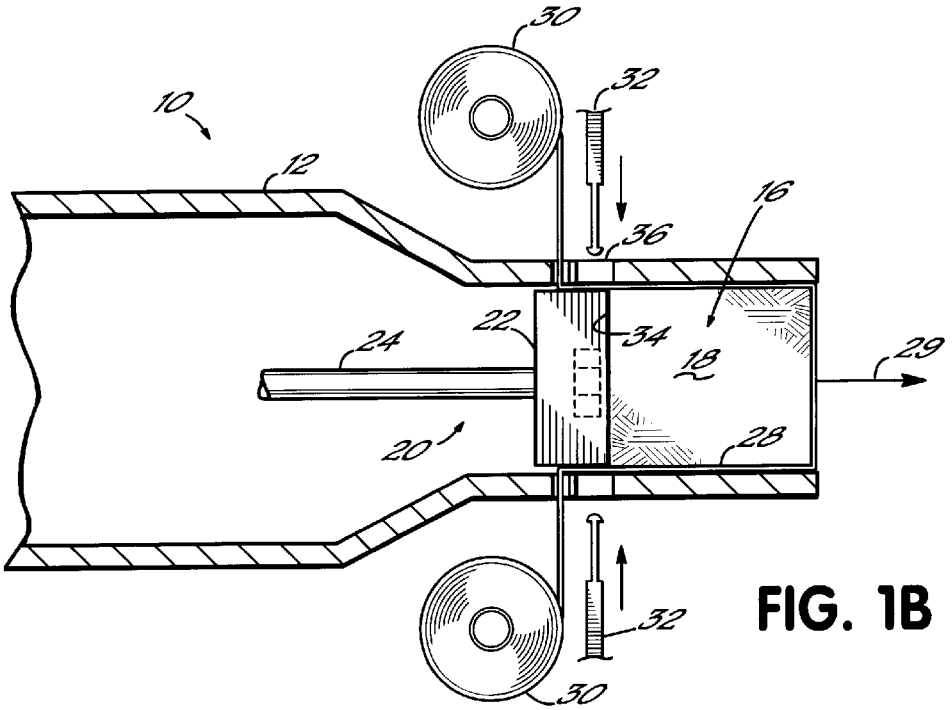

Referring now to FIG. 1B, ram 20 drives the bale 18 into a compressed form within the baling area 16. After the bale 18 has been wrapped and tied, it will be ejected through an outlet end 33 of the baler. As bale 18 moves along path 29, the continuous wire strands 28 wrap around the front end of the bale and then down along the sides of the bale, as illustrated in FIG. 1B. The bale continues to move downstream in path 29 until the continuous strand has passed the rear end 34 of bale 18. At that point, the bale is ready to be tied and completed after the wrap has been completed around the rear end 34. To that end, the opposing arm elements will move toward each other to engage path 29, generally transverse to path 29 as shown in FIGS. 1B and 1C.

Figure 1C:
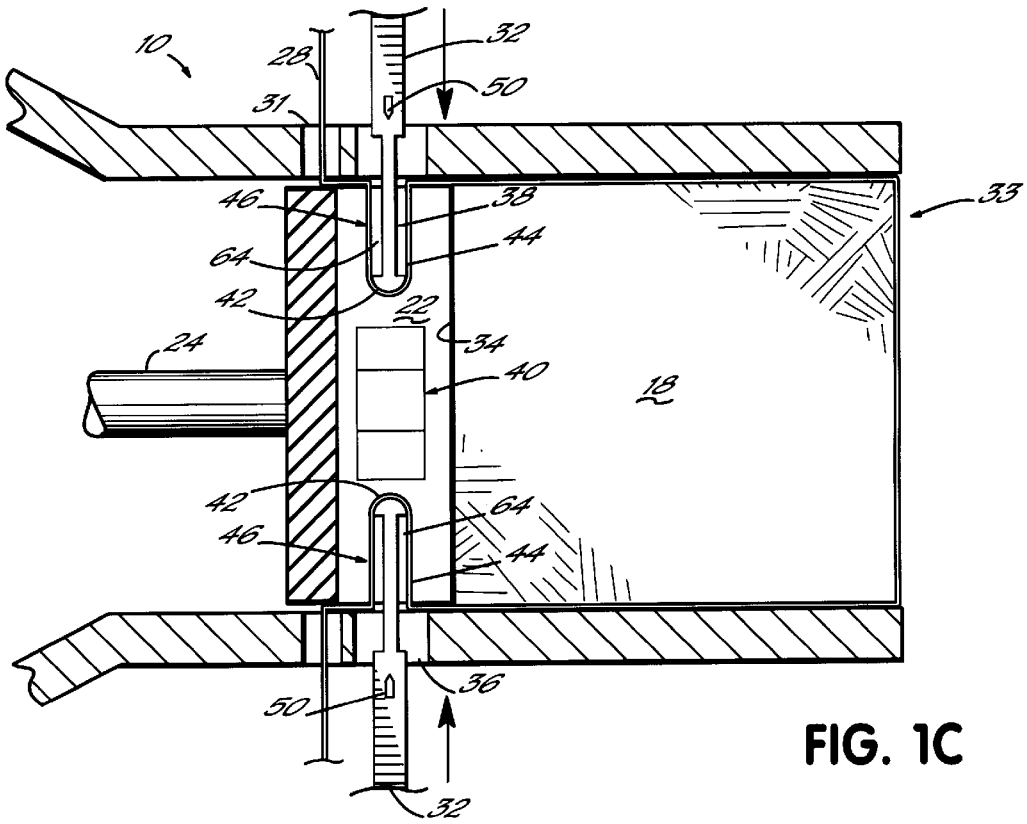

More specifically, FIG. 1C illustrates the opposing arm elements 32 moving toward each other across the bale path 29 and behind the rear end 34 of the bale 18. The opposing arm elements 32 move through the frame 12 through appropriately formed apertures 36 in the frame. The frame may also be configured to encompass the arm elements. The arm elements 32 are coupled to suitable mechanisms (not shown) for moving the arm elements toward and away from path 29. As shown, the arm elements translate generally horizontally. Each of the sets of opposing arm elements 32 are positioned at the same height of the continuous strands of wire 28 wrapped around the bale. That is, each arm element set corresponds to a strand 28. Therefore, the ends of the opposing arm elements 32 engage the continuous strands of wire 28. (See FIG. 3.)

In one embodiment of the invention, the ram head 22 includes a plurality of slots 38 formed in sidewalls 39 which receive the opposing arm elements 32 as they move into position behind the bale 18. A twisting mechanism 40 is positioned within the ram head 22 to engage the opposing arm elements once they overlap to form overlapped sections of wire as discussed further hereinbelow. When each arm element engages one side of the continuous wire strand 28 proximate the rear end 34 of bale 18, the arm element forms a loop 42. As illustrated in FIG. 1C, each loop 42 includes a downstream section 44 and an upstream section 46. The arm elements 32 continue to move toward each other within the bate head 22 until ends of the arm elements overlap and form overlapped sections of the wire loops (see FIG. 1D).

Figure 1D:
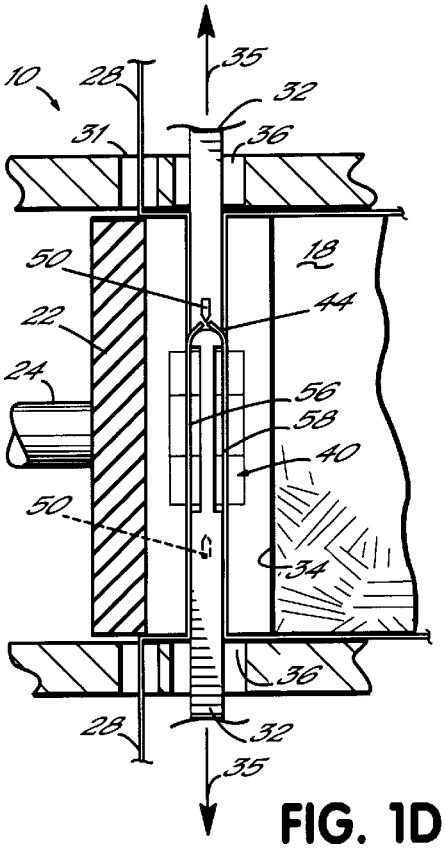

Turning now to FIG. 1D, the overlapped loops 42 are shown proximate the center of the ram head 22. The overlapped loops include overlapped upstream sections 46 and overlapped downstream sections 44. A blade 50 is positioned on each arm element 32 to engage the end of the other opposing arm element. Referring to FIG. 1D, the position of the blades 50 is shown for cutting of the loops. When the arm elements move together, the blade 50 cuts the loop 42 between the upstream section 46 and the downstream section 44. Each arm element includes a blade 50 and thus both of the opposing and overlapped loops 42 are cut so that the overlapped upstream sections 46 are separated from the overlapped downstream sections 44.

Figure 4:
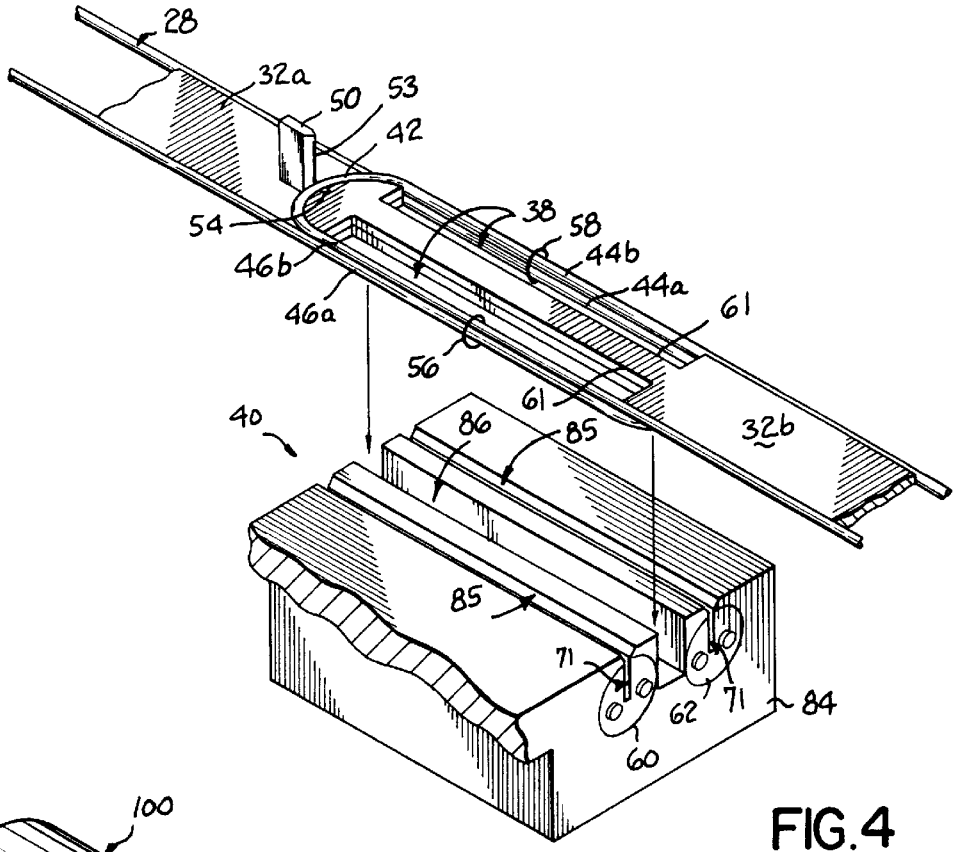
FIG. 4 is a disassembled view of a twisting mechanism consistent with the invention.

Referring to FIG. 4, the perspective view illustrates one blade 50 and its interaction with the end of the arm element. Specifically, the arm element 32*a* includes an upstanding blade 50 having a sharp forward edge 53. The opposing arm element 32*b* includes a notch 54 formed in the end thereof. The sharp edge 53 of the blade 50 moves into notch 54 and thereby cuts the wire loop 42 formed by arm 32*b* to form a separate downstream section 44 and upstream section 46. Similarly, the arm element 32*b* includes a blade (not shown in FIG. 4) which engages a front end and notch of the arm element 32*a* to cut the loop 42 associated therewith. In that way, upstream section 46*a* of the loop formed by arm element 32*a* overlaps with upstream section 46*b* of the loop formed by arm element 32*b* and downstream section 44*a* overlaps with downstream section 44*b*. The overlap defined by sections 44*a* and 44*b* forms a bale overlapped section 58 while the overlap of sections 46*a* and 46*b* defines a supply overlapped section 56. As discussed further hereinbelow, the supply overlapped section 56 is twisted or tied to reform the continuous strand of wire 28.

The arm elements 32 are tongue-like in shape and have rounded ends to form the wire loops 42. Preferably, the arm elements 32 are dimensioned to form a wide enough loop so that the twisting mechanism of the invention may properly engage the overlapped sections 56, 58. The arm elements 32 may include appropriately shaped grooves or tracks (not shown) formed in the rounded ends thereof for holding the wires 28 in place on the ends of the arm elements.

Figure 1E:
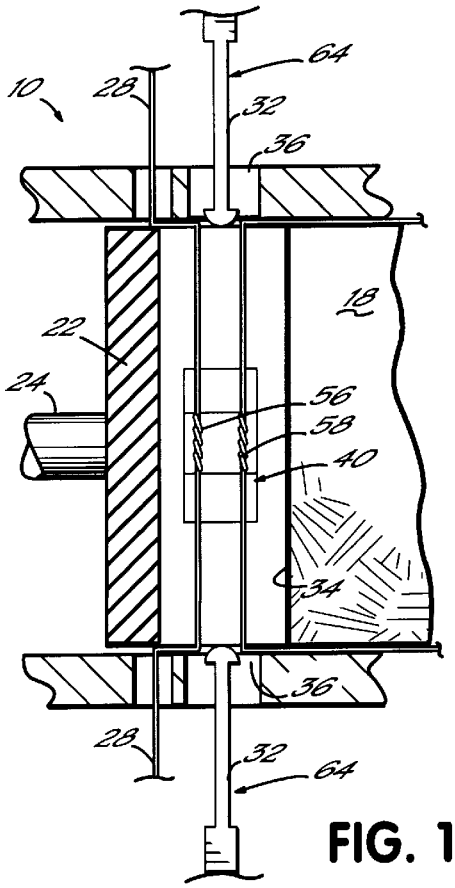
Figure 1F:
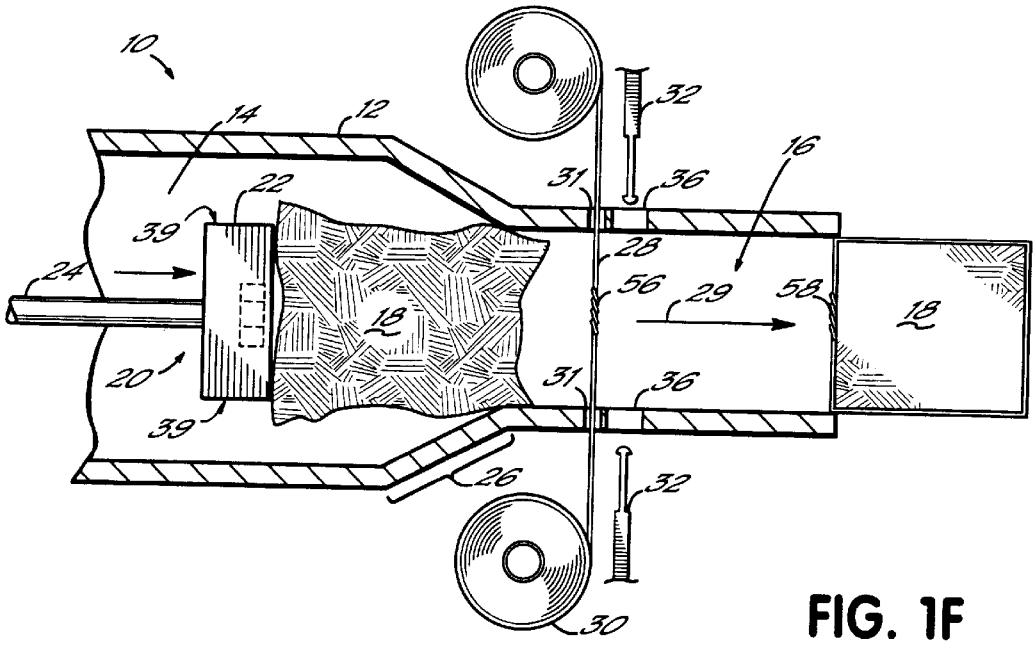

Referring again to FIG. 1D, the supply overlapped section 56 and bale overlapped section 58 are engaged by twisting mechanism 40 which twists the overlapped sections and forms wire twists as shown in FIG. 1E, and also designated with the same numerals 56 and 58. The bale overlapped section 58 completes the wrapped wire 28 around the bale 18 and thus ties the bale. As mentioned above, multiple wires 28 are tied in this way around bale 18 to keep the bale together. The supply overlapped section 56, on the other hand, is tied together to again form or reform a continuous strand of wire 28 in the path of the bale (see FIG. 1F). After the twisting mechanism 40 twists the overlapped sections 56, 58, the arm elements 32 disengage from the loops 42 and are withdrawn away from the ram head 22 as shown in FIG. 1E. The twisting mechanism 40 fits into notches 64 formed in the arm, and thus the arm elements 32 will remain inside of the ram head 22 until the twists are formed.

Bale 18, which has been tied, is then ejected from the baler 10 through the outlet opening 33 as shown. The removal of the arm elements 32 through the slots 38 in the sidewalls 39 will allow the ram 20 to be moved further downstream to eject the bale and then back upstream on path 29 to receive the next bale 18*a*. The next bale of material 18*a* then moves into position under the direction of ram 20 and the entire process begins again. In that way, successive bales are automatically and continuously tied. Again, as shown in FIG. 1E, after the overlapped sections 56 and 58 are twisted to tie the loose ends of the wire together, the opposing arm elements 32 move in the opposite direction to disengage from the baler head 22, as illustrated by arrows 35 in FIG. 1D. FIG. 1E shows the opposing arm elements in the withdrawn position so that bale 18 may be pushed out of the baler.

Figure 2:
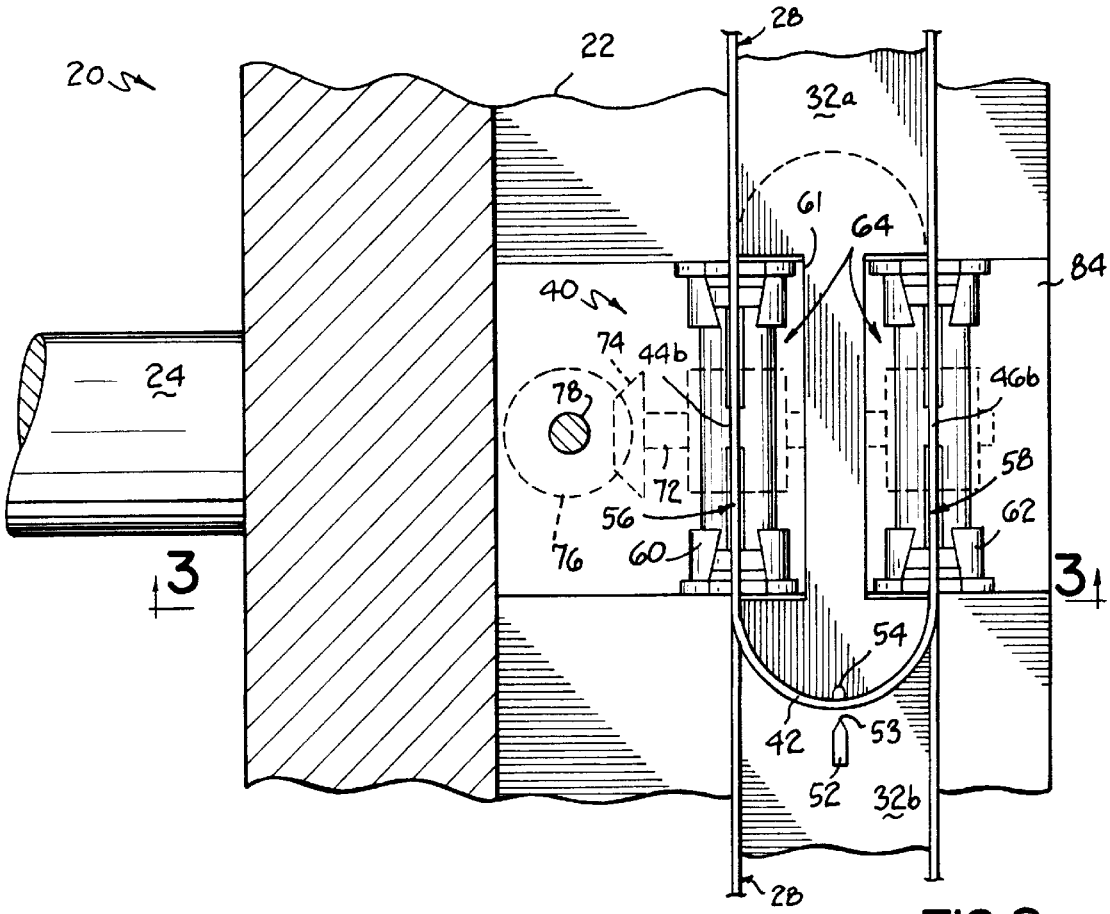
FIG. 2 is a top cross-sectional view of a portion of the automatic baler consistent with the invention illustrating multiple pinion engagement of overlapped wire sections.

The twisting mechanism 40 of the invention, is shown in greater detail in FIG. 2. The twisting mechanism 40 includes at least two twister pinions with one twister pinion configured to engage the supply overlapped section 56 and the other twister pinion configured to engage the bale overlapped section 58. To that end, twister pinion 60 engages the supply overlapped section 56 while twister pinion 62 engages the bale overlapped section 58. As illustrated in FIG. 2, each of the arm elements 32 are notched with notches 64 at the end for being engaged by the twister mechanism 40 which includes pinions 60 and 62. In that way, the twister pinions 60, 62 may engage the overlapped wire sections 56, 58 simultaneously to thereby simultaneously twist and tie the wires to complete the tying of the bale and also to reform the continuous strand of wire to engage the next bale moving along the path through the baler. When the arm elements 32 overlap, the respective notches 64 therein are aligned to receive the twister pinions 60, 62. The twister pinions may be moved from above or below the arm elements 32 and into the notches 64 to engage the overlapped sections 56, 58. The embodiment illustrated in the figures engages the wire loops from below.

Figure 3:
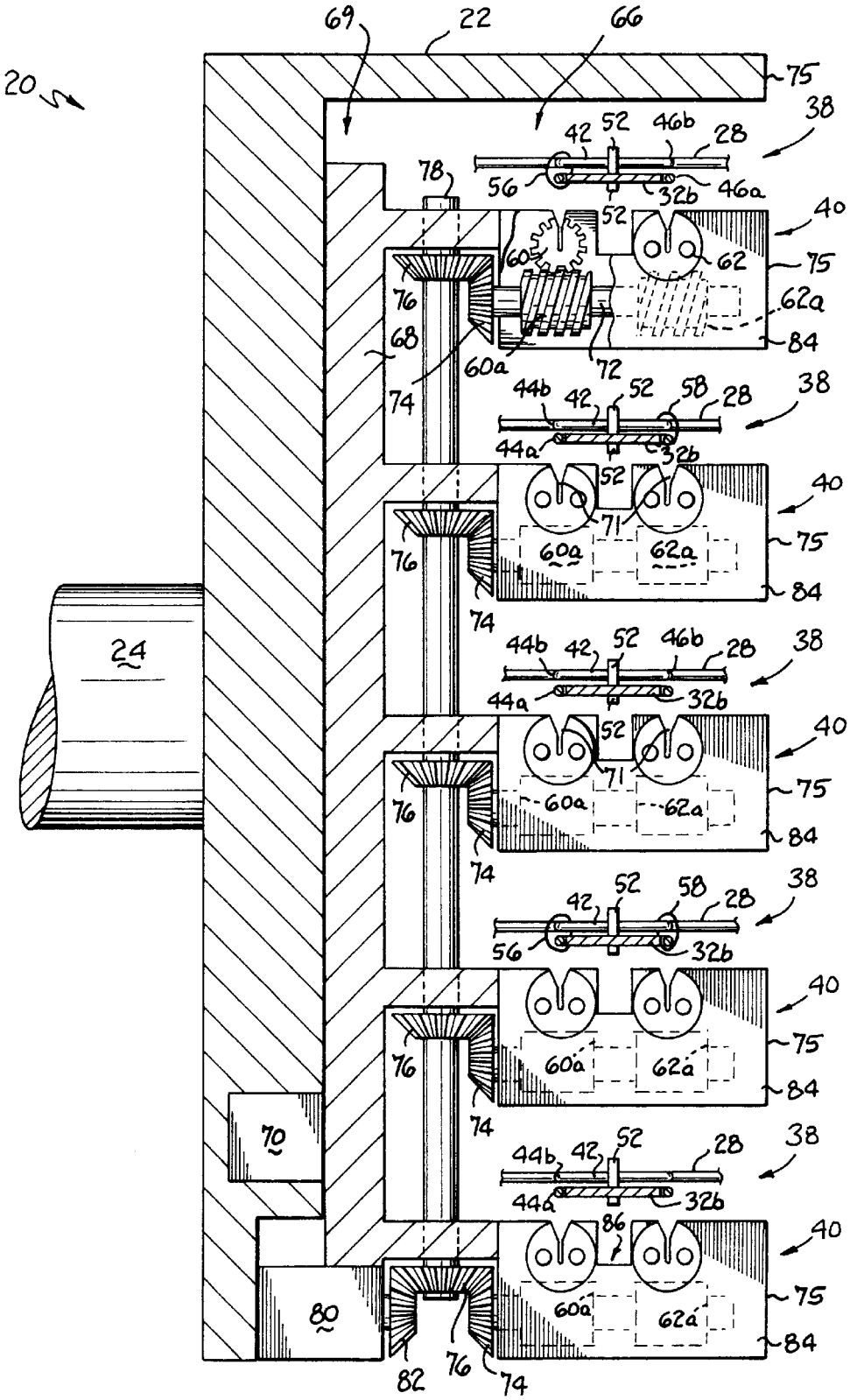
FIG. 3 is a side cross-sectional view of a ram head consistent with the invention.

In one embodiment of the invention, multiple opposing arm elements 32 and multiple twisting mechanisms 40 are utilized for wrapping and tying a bale at several positions. Referring to FIG. 3, the twisting mechanism 40 is illustrated cantilevered within the ram head 22. Slots 38 are formed from the sidewalls 39 and across the front wall 75 of the ram head 22 so that when the wires save been twisted, the ram may be withdrawn and the wires will slide out of the slots 38 so that the wrapped and tied bale 18 may continue out of the baler and the continuous strand 28 is ready to receive the next successive bale. Each of the twisting mechanisms 40 is mounted in a vertically stacked relation, and the stack, indicated by reference numeral 68 is slidably mounted within the ram head 22 for being vertically translated within a slot 69 in the ram head 22. To that end, the stack 68 of twisting mechanisms 40 is coupled to a translating mechanism 70 which is operable for sliding the stack vertically upwardly so that the twisting mechanisms 40 engage the respective overlapped wire sections from below to thereby twist and tie those overlapped sections. For example, referring to FIG. 1D, when the arm elements 32 have moved together such that the notches 64 align and the various bale overlapped sections 58 and supply overlapped sections 56 are formed, the translating mechanism 70 will raise stack 68 to raise the various twisting mechanisms 40 to engage the overlapped arm elements. That is, the notches 64 align and the stack of twisting mechanisms is moved upwardly into position to tie the overlapped wire sections 56, 58.

In a preferred embodiment of the invention, the notches are dimensioned so that the arm elements may be further moved after the twisting mechanisms 40 have moved into place and the rollers are positioned within the notches. That is, the notches 64 are dimensioned so that there is some play in their movement with respect to the twister pinions. Referring to FIG. 2, when the arms come together to create the bale and supply overlapped sections 58, 56, the arm elements 32 are not extended to their full length to engage the blade 52. In that way, the wires 28 are not cut and will remain overlapped while the twisting mechanism is moved into place. After the overlapped wire sections 56, 58 have slid down into the slots 71 of the twister pinions (see FIG. 4), each of the opposing arm elements are moved further such that the blades 50 are received by the notches 54 and the wire loops 42 formed by the opposing arm elements 32 are cut between the various overlapped sections 56, 58. In that way, the alignment of the wires is assured until they are received by the twister pinions 60, 62.

After the wires have been cut by the blade 50, they are ready to be twisted together. For handling the twisting, each of the pinions 60, 62 is coupled to an appropriate worm gear 60*a* and 62*a*, as illustrated in FIG. 3. The worm gears 60*a*, 62*a* are coupled together to a shaft 72 which, in turn, is coupled to a beveled driven gear 74. A plurality of beveled drive gears 76 are coupled together along a drive shaft 78. The beveled drive gears 76 engage the respective beveled driven gears 74 for each twisting mechanism 40 such that when the drive shaft 78 rotates, the shaft 72 and worm gears 60*a*, 62*a* are rotated to rotate the respective pinions 60, 62. Drive shaft is coupled to a drive motor 80 by another drive gear 82 and one of the endmost gears 76, as illustrated in FIG. 3. A motor 80 rotates the shaft 78 and thereby turns all of the pinions 60, 62 simultaneously to simultaneously twist the overlapped wire sections and tie the wire ends together throughout the bale and also reform the continuous baling wire strand.

The twister pinions 60, 62 are rotatably mounted within blocks 84 coupled to the stack 68 (see FIG. 4). The blocks 84 are appropriately formed such that slots 85 therein align with and couple with the slots 71 of the twister pinions 60, 62. Another slot 86 formed in the block 84 receives the section of the arm elements 32 between the notches 64 formed in the ends of the arm elements. In that way, as illustrated in FIG. 2, the block and twister pinions may engage the overlapped arm elements. After the overlapped wire sections 56, 58 are twisted together, the stack is lowered to disengage the pinions 60, 62 from the arm elements 32. The arm elements may then be withdrawn from the ram head 22.

Consistent with the invention, any suitable pinion may be utilized in the twisting mechanism 40. In one embodiment of the invention a twister pinion having sloped end surfaces may be utilized to facilitate proper alignment of the overlapped wire sections 56, 58 within the twister pinions 60, 62.

Figure 5:
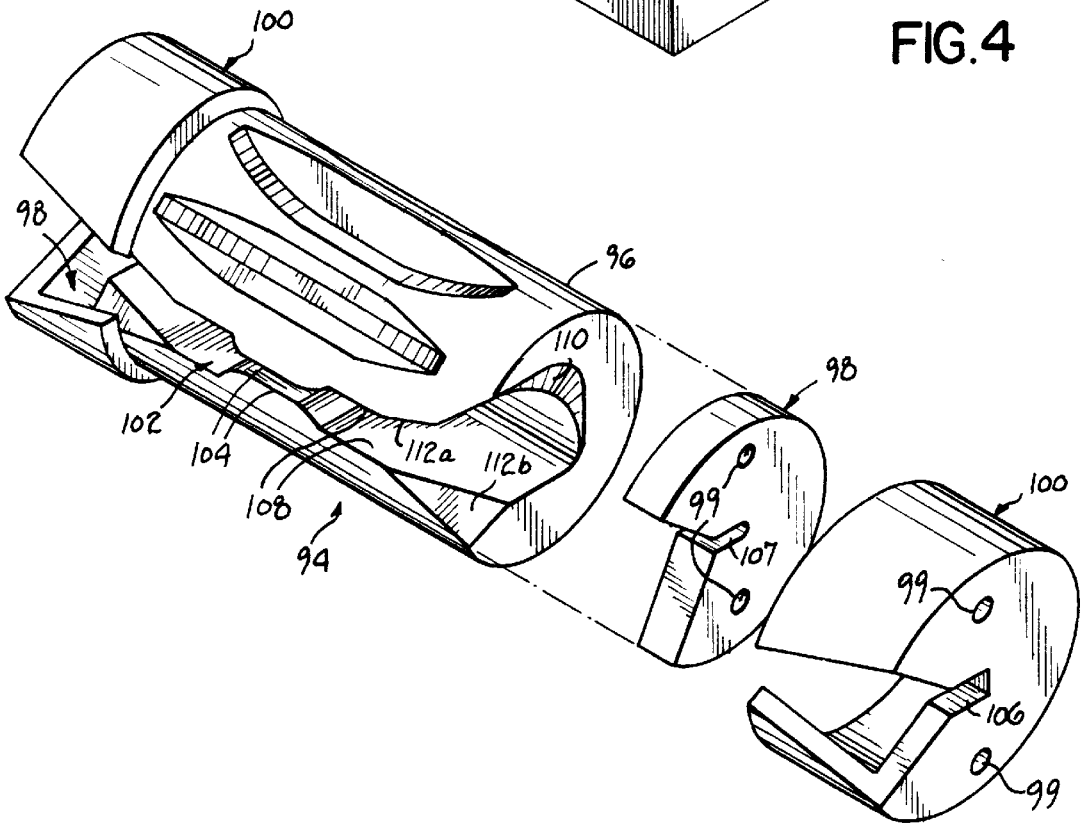
FIG. 5 is an exploded perspective view of one type of twister pinion to be utilized in the twisting mechanism of present invention.

Referring now to FIG. 5, one suitable twister pinion, designated as 94, is shown in greater detail. Twister pinion 94 includes a cylindrical pinion body 96 which is coupled at its end with opposing yokes 98 and bronze cap bushings or end caps 100. The pinion body 96 is preferably formed of tool steel. The ends of the pinion body 96 abut against yokes 98 and rotate thereagainst. Yokes 98 are preferably formed of steel for easy and low friction rotation of the pinion body. The yokes 98 and bushings 100 are coupled together when the mechanism is assembled using bolts (not shown) which fit into apertures 99.

The pinion body 96, yokes 98 and bushings 100 are assembled together to form pinion 94 which has a longitudinal slot 102 therein. The generally cylindrical yokes 98 and bushings 100 have wedge-shaped removed sections, as illustrated in FIG. 5, for forming a portion of slot 102. The slot 85 of block 84 aligns with the longitudinal slot 102 of the twister pinion 94 for receiving overlapped wire ends. When the twisting mechanism 40 is assembled, the bushings 100 and yokes 98 are held stationary with respect to block 84, by appropriate fasteners, such as bolts (not shown) which extend into appropriate openings formed in the block 84. In that way, bushings 100 and yokes 98 are held stationary with respect to block 84 and rotating pinion 94.

The pinion body 96, however, rotates between the bushings 100 and yokes 98. When overlapped wire ends 56, 58 are inserted into the twister pinion slot 102, rotation of the pinion body 96 will twist the overlapped wire ends to form a knot. A portion of slot 102 formed in twister pinion body 96 has a pair of raised projections 104 which extend into slot 102, generally at the longitudinal center of the body 96. When slot 102 receives the overlapped wire ends, the projections 104 hold the overlapped wire ends next to each other at the center section of the overlap to prevent the relative rotation of the overlap center section with respect to the pinion. That is, the overlapped ends remain untwisted in the center. The space or gap between the projections 104 is sufficient to allow the overlapped wire ends to slide into the slot 102 while maintaining the wire sections next to each other at the projections 104. As will be appreciated, the gap between the projections 104 and the width of slot 102 can be dimensioned for a variety of wire gauges, depending upon the use of the twisting mechanism 40.

When the overlapped wires are twisted using a pinion similar to pinion 94, the center and the outer sections of the overlapped wire portions remain untwisted. That is, the side-by-side sections of the overlapped wire sections are maintained relatively stationary with respect to each other at the center and at the outer ends of the overlapped wire sections. Referring to FIG. 5, the bushings 100 and yokes 98 each include narrow slot sections 106, 107, respectively. The narrow slot sections 106, 107 operate in conjunction with each other to hold the outer ends of the overlapped wire sections stationary with respect to the rotating pinion body 96. As pinion body 96 rotates, the projections 104 grip the overlapped wire sections at the center, and the rotation of the pinion body 96 twists the overlapped wire portions together between the center and the outer ends.

In accordance with the principles of the present invention, twister pinion 94 is preferably configured to direct the overlapped wires into the centermost position of the twister assembly slot 102. Referring to FIG. 5, the side walls 108 of the portion of slot 102 formed by pinion body 28 are generally flat. However, the ends of the pinion body 96 include sloped or angled surfaces 110. The angled surfaces 110 preferably are spirally-shaped and spiral inwardly from the perimeter of the pinion body 96 toward the center rotational axis of body 96. As the surfaces 110 spiral, they also slope or extend longitudinally from the ends of the pinion body 96 toward the projections 104 in the longitudinal center of body 96. Therefore, as shown in FIG. 5, surfaces 110 slope in a spiral fashion into the center of the pinion. The spiral surfaces 110 direct the overlapped wire ends into the center of the pinion when the pinion rotates and the twist is formed.

On either side of slot 102 at both ends of the pinion body, additional angled surfaces 112*a*, 112*b* slope inwardly toward the center of the pinion and slope in the longitudinal direction from the ends of body 96 toward the projections 104. The combination of the inwardly angled surfaces 110 and 112*a*, 112*b* acts to direct the overlapped wire sections to the center of body 96 such that a sufficient twist is formed when the body 96 rotates. Greater details regarding pinion 94 are disclosed in U.S. Pat. No. 5,704,283 and U.S. Ser. No. 08/947,457, which patent and pending application are completely incorporated herein by reference in their entireties.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details representative apparatus and method, and illustrative examples shown and described. Accordingly, departures may be made from such details without departure from the spirit or scope of applicants general inventive concept.

What is claimed is:

1. An automatic baler for creating a bale of compressible material, the automatic baler comprising:

a mechanism for compressing an amount of a compressible material into a bale and moving the bale in a direction along a path;

a supply of baling wire forming a continuous strand of wire which extends generally transverse to the path to engage a front end of the bale and wrap around the bale as it moves along said path;

opposing arm elements positioned on opposite sides of the path, the arm elements being movable toward each other and being operable for engaging sections of said continuous wire strand to move the strand sections across a rear end of the bale;

the opposing arm elements operable for forming at least two overlapped sections of wire proximate the rear end of the bale, each of said arm elements having notches formed therein;

a twisting mechanism including at least two twister pinions, the twister pinions configured to fit into said notches to engage the overlapped wire sections simultaneously and tie the overlapped wire sections to secure the wire wrapped around the bale and to reform a continuous strand of wire to engage the next bale moving along the path;

whereby successive bales may be automatically and continuously tied.

2. The baler of claim 1 wherein said compressing mechanism includes a reciprocating ram for pushing the bale along the path through the baler.

3. The baler of claim 1 further comprising a cutting mechanism for cutting said wire proximate the overlapped sections to form a bale overlapped section and a supply overlapped section.

4. The baler of claim 3 wherein said cutting mechanism includes a blade positioned on at least one of said arm elements to cut the wire proximate the overlapped sections.

5. The baler of claim 4 wherein said cutting mechanism includes a cutting blade on each of the arm elements to cut the wire proximate the overlapped sections.

6. The baler of claim 1 wherein each of said arm elements is operable for forming a wire loop having an upstream section and a downstream section when the arms move toward each other, the loops opposing each other such that the downstream sections of the loops overlap to form a bale overlapped section and the upstream sections of the loops overlap to form a supply overlapped section.

7. The baler of claim 6 further comprising a cutting mechanism for cutting said wire loops between their upstream and downstream sections to form the bale overlapped section and the supply overlapped section.

8. The baler of claim 1 wherein said twister pinions are rotationally coupled to a worm gear, the worm gear operable for simultaneously rotating the twister pinions.

9. The baler of claim 1 further comprising multiple sets of arm elements and multiple corresponding sets of twister pinions for wrapping and tying a bale with multiple strands of wire.

10. The baler of claim 1 wherein said notches are formed on opposite sides of the arm elements, said twister pinions configured for fitting into notches on either side of the arm element, to engage the overlapped wire sections.

11. The baler of claim 1 wherein said arm elements partially overlap to form said overlapped sections of wire, the notches aligning on the overlapped arm elements for receiving said twister pinions.

12. The baler of claim 1 wherein said twisting mechanism is coupled to said compressing mechanism to move with the bale of material along the path.

13. The baler of claim 12 wherein said compressing mechanism includes slots formed in sidewalls thereof for receiving said opposing arm elements, the arm elements forming said overlapped wire sections within a portion of the compressing mechanism.

14. The baler of claim 13 wherein said compressing mechanism includes a slot extending through a front wall of the compressing mechanism for allowing tied overlapped wire sections to escape from said portion of the compressing mechanism when the compressing mechanism is moved in an opposite direction along the path.

15. An automatic baler for tying a bale of compressible material moving along a path and having a strand of wire wrapped therearound, the automatic baler comprising:

opposing arm elements for being positioned on opposite sides of the path, the arm elements being movable toward each other to engage the path and being operable for engaging sections of said wire strand to move the strand sections across a rear end of a bale;

the opposing arm elements operable for forming at least two overlapped sections of wire proximate the rear end of the bale, each of said arm elements having notches formed therein;

a twisting mechanism including at least two twister pinions, the twister pinions configured to fit into said notches to engage the overlapped wire sections simultaneously and tie the overlapped wire sections to secure the wire wrapped around the bale and to reform a continuous strand of wire to engage another bale moving along the path;

whereby successive bales may be automatically and continuously tied.

16. The baler of claim 15 further comprising a cutting mechanism for cutting said wire strand proximate the overlapped sections to form a bale overlapped section and a supply overlapped section.

17. The baler of claim 15 wherein each of said arm elements is operable for forming a wire loop having an upstream section and a downstream section when the arms move toward each other, the loops opposing each other such that the downstream sections of the loops overlap to form a bale overlapped section and the upstream sections of the loops overlap to form a supply overlapped section.

18. The baler of claim 15 further comprising multiple sets of arm elements and multiple corresponding sets of twister pinions for wrapping and tying a bale with multiple strands of wire.

19. The baler of claim 15 wherein said notches are formed on opposite sides of the arm elements, said twister pinions configured for fitting into notches on either side of the arm element, to engage the overlapped wire sections.

20. The baler of claim 15 wherein said arm elements partially overlap to form said overlapped sections of wire, the notches aligning on the overlapped arm elements for receiving said twister pinions.

* * * * *